US005429334A

United States Patent [19]

Hutchison

[11] Patent Number: 5,429,334

[45] **Date of Patent: * Jul. 4, 1995**

[54] DISPLAY BRACKET FOR USE WITH PEGBOARD PANELS

[76] Inventor: V. James Hutchison, 1949 S. Robb Way, Lakewood, Colo. 80228

[ * ] Notice: The portion of the term of this patent subsequent to Jan. 21, 2009 has been disclaimed.

[21] Appl. No.: 914,980

[22] Filed: Jul. 16, 1992

[51] Int. Cl.[6] ..... A47G 29/10

[52] U.S. Cl. ..... 248/220.4; 40/657; 211/59.1

[58] Field of Search ..... 248/220.4, 221.1; 40/657; 211/59.1, 57.1

[56] References Cited

U.S. PATENT DOCUMENTS

| | | | |
|---|---|---|---|
| 2,913,210 | 11/1959 | Tichnor | 248/221.1 |
| 2,991,968 | 7/1961 | Lydard | 248/221.1 |
| 3,187,902 | 6/1965 | Nelson | 248/221.1 |
| 3,193,231 | 7/1965 | Curry | 248/221.1 |
| 3,912,084 | 10/1975 | Valiulis | 248/220.4 |
| 4,394,909 | 7/1983 | Valiulis et al. | 248/220.3 |
| 4,773,172 | 9/1988 | Fast | 248/220.4 |
| 4,987,692 | 1/1991 | Fast | 40/657 |
| 5,082,215 | 1/1992 | Hutchison | 248/220.4 |

FOREIGN PATENT DOCUMENTS

| | | | |
|---|---|---|---|
| 2610446 | 9/1977 | Germany | 248/220.4 |

*Primary Examiner*—Hien H. Phan
*Attorney, Agent, or Firm*—Timothy J. Martin

[57] ABSTRACT

An information display bracket mounts directly to an upright pegboard support panel for use in cooperation with a product support bracket mounted on the support pane. The information display bracket includes a base member having one of several disclosed mounting structures, a display arm hingedly connected at a proximal end to the base member such-as by a living hinge structure, and a display plate located on the distal end of the display arm. The display arm has a flattened distal end portion, preferably rectangular in shape, and is sized to cooperate with a selected product support bracket such that the flattened distal end portion rests on the free end of the product support arm of the product support bracket when fastened to the support panel above the product support bracket. The base member has at least one but preferably a plurality of mounting posts that frictionally resiliently engage respective mounting holes. Also, disclosure is made of a pair of mounting posts configured to arcuately bow the base member thereby to enhance fastening to the support panel.

20 Claims, 3 Drawing Sheets

DISPLAY BRACKET FOR USE WITH PEGBOARD PANELS

FIELD OF THE INVENTION

The present invention relates to an information display bracket which can be secured to an upright pegboard support panel above a product support bracket also secured to the pegboard support panel. Particularly, this display bracket may be mounted to the pegboard panel without displacing either previously mounted product support brackets or products displayed on the various product support brackets in the merchandising system. Information, such as selling price, UPC code, item identifiers, etc., can be presented on the display bracket.

BACKGROUND OF THE INVENTION

Store owners and other merchandisers commonly display products on upright pegboard merchandising systems. In these merchandising systems, an upright pegboard provides a vertically oriented support surface, upon which product support brackets are mounted. Typically, the pegboard support has a front surface forming a background for the product display, and a matrix of uniformly spaced holes are formed through the pegboard support in order that product support brackets may be mounted and supported thereon. The pegboard panel is normally selected to be one of standardized thickness and the holes in the matrix are arranged in horizontal rows and vertical columns so that four adjacent holes are located at the corners of an imaginary square.

Product support brackets are constructed for use with such a pegboard support and are generally in the form of a product support arm which is attached to a mounting base that usually has a pair of horizontal mounting progs which extend rearwardly in the mounting base to engage a pair of mounting holes adjacent one another on a selected row of the pegboard holes. Some support brackets, however, may contain less or more rearwardly projecting prongs or may mount on a single vertical column of mounting holes. In any event, the mounting base is securely retained on the front surface of the pegboard support by virtue of the prongs extended through the selected mounting holes. The product support brackets are primarily standardized lengths, and the merchant hangs products for display onto the various product support arms from an array of product support brackets so that the products may be sequentially removed from the respective product support arm, for example, by customers. In this manner, a variety of products or items can be displayed with high density and in a pleasing and organized manner.

It is often the case that the user of these pegboard merchandising systems desires to present information in conjunction with the product display. Usually, this information comprises the price of the product, but other information, such as inventory control information, descriptive material, product name and the like, is often appropriate for presentation in conjunction with the product display. The value of displaying information in conjunction with a product has been recognized in the past. To this end, unitary product support and information display brackets have been constructed for use with pegboard systems. Examples of these unitary systems are described in the following list of patents:

| U.S. Pat. No. | Inventor | Issue Date |
|---|---|---|
| 3,345,547 | Felkay | 12 Apr. 1966 |
| 3,645,485 | Gold | 29 Feb. 1972 |
| 4,246,710 | Mixer | 27 Jan. 1981 |
| 4,286,764 | Pfeifer | 1 Sep. 1981 |
| 4,303,217 | Garfinkle | 1 Dec. 1981 |
| 4,351,440 | Thalenfeld | 28 Sep. 1982 |
| 4,405,051 | Thalenfeld | 20 Sep. 1983 |
| 4,474,351 | Thalenfeld | 2 Oct. 1984 |
| 4,520,978 | Taub | 4 June 1985 |
| 4,540,093 | Merl et al | 10 Sep. 1985 |
| 4,674,721 | Thalenfeld | 23 June 1987 |
| 4,750,698 | Barnes | 14 June 1988 |

Foreign Patent

| Patent No. | Inventor | Issue Date |
|---|---|---|
| 2,726,158 | Freitag | 14 Dec. 1978 |

While the above referenced patents are suitable to display both products and information correlated to the products, the complete replacement of product support brackets which do not have unitary information displays is costly, and it may be appreciated that an information display that is adapted to retro-fit onto existing "product only" display brackets can be desirable. Indeed, there has, in the past, been some development of information displays which retro-fit onto product only display brackets. A prime example of such a retro-fit display is shown in my U.S. Pat. No. 5,012,997 issued May 7, 1991. In this patent, an auxiliary information display bracket is described which is adapted to retrofit onto existing product display brackets so that information may be presented proximate to the display of that item. Another retro-fit display bracket is shown in my U.S. Pat. No. 5,082,215 issued Jan. 21, 1992. In the '215 patent, I describe a display bracket with a living hinge structure that mounts between the mounting base of a product support bracket and a pegboard support. Other examples of retro-fit price display elements are shown in the following list of patents:

| U.S. Pat. No. | Inventor | Issue Date |
|---|---|---|
| 4,463,510 | Windish | 7 Aug. 1984 |
| 4,525,944 | Fast | 2 July 1985 |
| 4,531,313 | Fast | 30 July 1985 |
| 4,583,308 | Taub | 22 Apr. 1986 |
| 4,646,454 | Fast | 3 March 1987 |
| 4,665,639 | Fast | 19 May 1987 |
| 4,693,024 | Fast | 15 Sep. 1987 |
| 4,698,929 | Fast | 13 Oct. 1987 |
| 4,703,570 | Fast | 3 Nov. 1987 |
| 4,715,135 | Fast | 29 Dec. 1987 |
| 4,773,172 | Fast | 27 Sept. 1988 |
| 4,882,868 | Fast | 28 Nov. 1989 |
| 4,976,058 | Fast | 11 Dec. 1990 |

In almost all of the retro-fit apparatus described in the above list of patents, a flexible strip is used as a mounting portion that is mounted between the front surface of the pegboard support and the mounting base of the product support bracket. The flexible strip then extends alongside and in contact with the product support arm and terminates, at a distal end, in a downturned display portion upon which information can be placed. A disadvantage of these various flexible strip assemblies, though, is that the flexible strip can often become dislodged so that it falls off of the product display arm to droop alongside the upright pegboard support. Not only does this dislodgment make the information display substantially useless, but also dislodgment causes the pegboard display system to appear messy and unattractive and can even interfere with the removal of product from the product support brackets. This disadvantage was, to a large degree, rectified by the structures described in my own U.S. Pat. Nos. 5,012,997 and 5,082,215 and in U.S. Pat. No. 4,976,058 to Valiulis.

Other patents have taught the use of hanger guards operative to shield the free end of a product support bracket. U.S. Pat. No. 3,912,084 issued Oct. 14, 1975 to Valiulis teaches a retro-fit hanger guard that mounts onto the base of a product support bracket between the base and the upright support panel. U.S. Pat. No. 4,394,909 issued Jul. 26, 1983 to Valiulis describes a telescoping hanger guard which mounts directly to the pegboard support in the matrix of mounting holes directly above the base member of a product support bracket. This guard flexes to allow removal of products, and the '909 patent discloses that information may be displayed on a free-end portion of the guard.

Despite the advantages and benefits of all of the above described prior art structures, there remained a need for improved display bracket structures which could work in conjunction with product display brackets in order to present information correlated to the product on the support bracket. Indeed, improved display bracket structures that had an increased ability to be retro-fitted onto merchandising pegboard systems without requiring removal of any product from any of the support brackets on the system were highly desirable from a time and cost saving standpoint. It is further desirable to have auxiliary information display brackets which can more easily be mounted in conjunction with existing product support brackets in order to display a product information. The present invention is directed, then to these further needs.

SUMMARY OF THE INVENTION

It is an object of the present invention to provide a new and useful information display bracket which can be used on a pegboard display system as a retro-fit item in conjunction with product-only display brackets.

It is another object of the present invention to provide an information display bracket for use with a product-only support bracket such that the information display surface on the information display bracket does not interfere with the product-only support bracket.

A further object of the present invention is to provide an information display bracket which may be used in conjunction with the product-only support brackets and which may retro-fit to the pegboard display system without the need to remove either the support bracket or products supported thereon.

Still another object of the present invention is to provide an information display bracket that is inexpensive to produce by convenient injection molding techniques.

Another object of the present invention is to provide an information display bracket which has a display arm that pivots in relationship to the product support arm of an associated product support bracket in order to provide easy access to products supported thereon.

Still a further object of the present invention is to provide an information display bracket with a base member which positively and resiliently engages the mounting holes of an upright pegboard support panel that are located immediately above the base member of a product-only support bracket in one or more columns in the matrix of mounting holes.

According to the present invention, then, an information display bracket is provided which is adapted to be used in conjunction with a product support bracket in a pegboard display system wherein the product support bracket has a product support arm for supporting products thereon and a mounting base for mounting on an upright support panel which has a plurality of mounting holes extending therethrough and organized as a matrix in vertical columns and horizontal rows. Specifically, the information display bracket is adapted to be used with a product support bracket that has a mounting base including at least one rearwardly projecting prong sized and positioned to extend through a first mounting hole located in a selected first row and first column of said matrix of holes so that the product support arm extends forwardly of said support panel to terminate in a free end when in a mounted state.

Broadly, the information display bracket according to the present invention includes a base member, a display arm and an information display plate onto which product related information may be placed. The base member includes at least one mounting post projecting rearwardly therefrom and sized to extend through a second mounting hole of the upright support panel which is located in a second selected row of the matrix of holes above the mounting base. The mounting post is configured to frictionally engage the second mounting hole thereby to fasten to base member in a fastened state to the support panel and, to this end, it is configured to resist withdrawal from the second mounting hole. The display arm has a proximal end hingedly secured to the base member and a distal end including a flattened distal end portion opposite the proximal end so that the display arm may project forwardly of the support panel when the base member is in the fastened state. The information display plate is located on the distal end of the display arm, and the display arm is sized so that the display plate is oriented forwardly of the free end of the product arm when the product support bracket is in the mounted state and the base member is in the fastened state. The display arm is thus able to freely pivot in a pivot plane that is perpendicular to the support panel between a first position wherein the flattened distal end portion is supported on the free end of the product arm and a second position wherein the flattened distal end portion and the display plate are located away from the free end of the product support arm so that products may be removed therefrom.

Preferably, the base member, the display arm and the display bracket are all formed as an integral piece of molded plastic material, and a living hinge structure interconnects the base member and the display arm to allow the vertical pivoting motion. The flattened distal end portion of the display arm is preferably rectangular in shape and is oriented perpendicularly to the display plate and in a plane perpendicular to the pivot plane so that the flattened distal end portion has a forward edge coextensive with the display plate. The mounting post for the base member preferably includes a pair of wing portions which diverge from one another and, if desired, may be supported on a post base that is cylindrical in shape of a common diameter with the mounting holes and which has a height, as measured from the base member, that is approximately the same thickness as the pegboard support panel.

While the present invention contemplates a base member having a single mounting post, it is preferable that a plurality of mounting posts be provided with each of the mounting posts projecting rearwardly from the base member so that they may extend through adjacent second mounting holes located in a selected row of the matrix of holes above the mounting base of the product support bracket. Here, each of the mounting posts is configured to engage the second mounting holes thereby to fasten the base member in a fastened state to the support panel and to resist withdrawal from the second mounting holes. Several configurations of mounting posts are contemplated where a plurality of mounting posts are used. As above, each mounting post may include a pair of divergent wing portions which may, if desired, be supported on a post base that is cylindrical in shape of common diameter with the mounting holes and a height that is the thickness of the support panel.

Alternatively, a pair of mounting posts may each include a wing portion projecting rearwardly of the base member with the wing portions on the pair of mounting posts being divergent from one another whereby the pair of mounting posts frictionally engage a pair of second mounting holes in the second row. Here again, the wing portions may be mounted on post bases as described above. The mounting posts and the base member are formed of a stiff, yet resilient plastic material whereby the mounting post are resiliently biased to engage the second mounting holes. The mounting base may then be formed as a flat piece of plastic material with the mounting posts being positioned so that the mounting base is slightly bowed when in the fastened state.

Alternatively, a first one of the mounting posts may be formed as an arcuate finger operative to engage one of the second mounting holes and a second one of the mounting posts is operative to frictionally engage another of the second mounting holes. Here, the arcuate finger is preferably oriented horizontally when the mounting base is in the fastened state. The second one of the mounting posts may then be of any of the types described above which are configured for frictionally engagement with the mounting holes of the support panel.

These and other objects of the present invention will become more readily appreciated and understood from a consideration of the following detailed description of the preferred embodiment when taken together with the accompanying drawings, in which:

DETAILED DESCRIPTION OF THE EXEMPLARY EMBODIMENTS

The present invention relates to merchandise display systems and particularly to information display brackets which may be used in conjunction with product support brackets which are mounted onto an upright pegboard support panel in order to display merchandise, products, etc. These merchandise display systems are especially useful in the retail sales field. The present invention is designed to mount onto an existing merchandise display system without the need to remove products from the various product support brackets in order to minimize the cost and time of retro-fitting such a merchandising system to provide an information bracket that can display such information as price, product code, etc.

Figure 1:
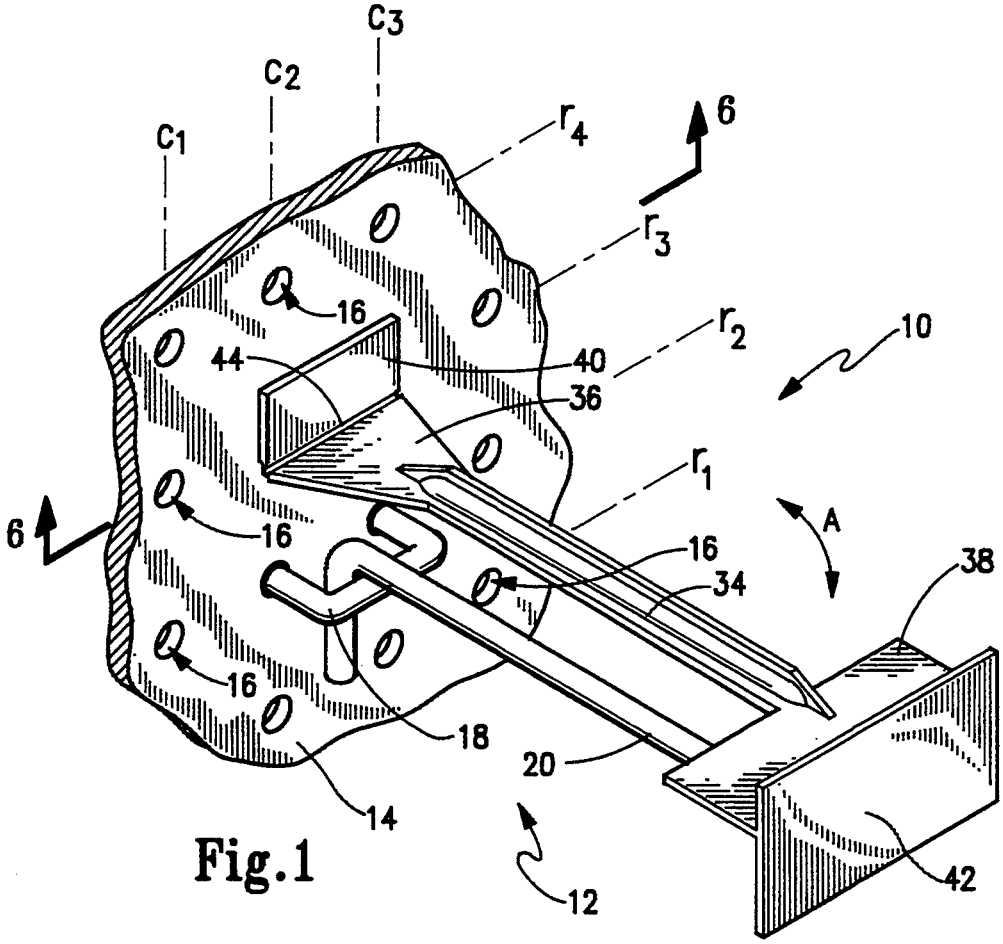
FIG. 1 is a perspective view of a first exemplary embodiment of the present invention shown in a mounted state on an upright pegboard support panel in conjunction with a product support bracket.
Figure 2:
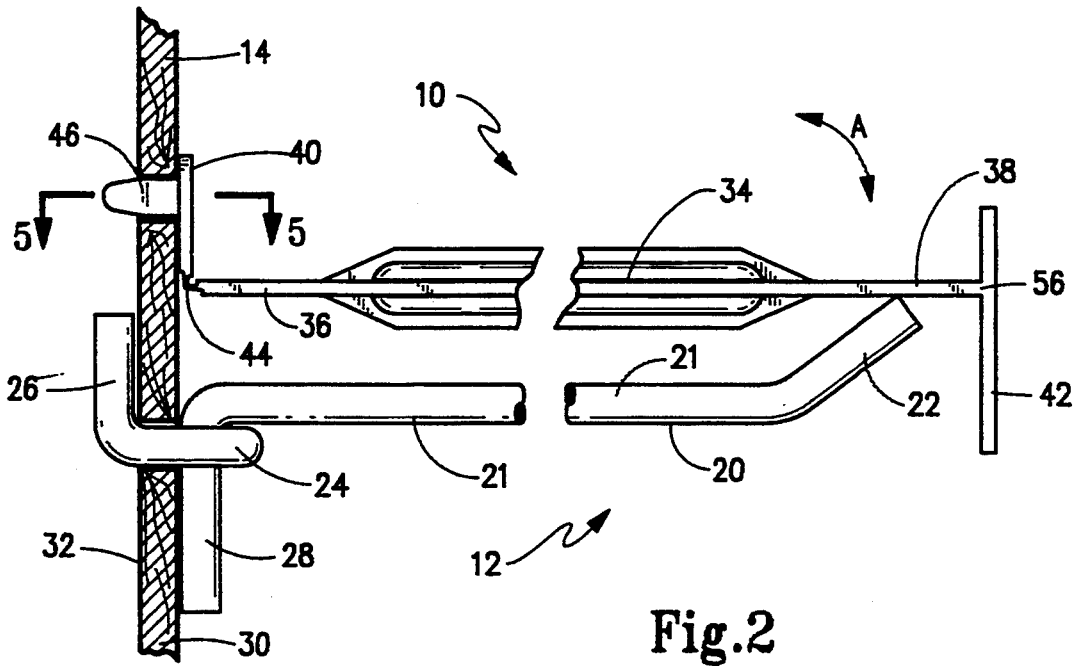
FIG. 2 is a side view in elevation of the information display bracket and product support bracket shown in FIG. 1.

As is best shown in FIGS. 1 and 2, information display bracket 10 according to a first exemplary embodiment of the present invention is adapted to be used in conjunction with a product support bracket 12, both of which are mounted to an upright pegboard support panel 14. To this end, as is well understood in the art, pegboard support panel 14 includes a plurality of mounting holes 16 which are arranged in a matrix of horizontal rows, such as rows $r_1$–$r_4$ and a plurality of vertical columns, such as columns $c_1$–$c_3$. Thus, four adjacent mounting holes 16 are located at the corners of an imaginary square. Product support bracket 12 includes a mounting base 18 which has a U-shaped bar 24 that extends through a pair of mounting holes 16 to terminate in a pair of upturned prongs 26 that extend along rear surface 32 of upright support panel 14. A product support arm 20 extends forwardly of front surface 30 of upright support panel 14 and is L-shaped in configuration. Thus, product support arm 20 has a downwardly turned short leg portion 28 and a long leg portion 21 that projects forwardly of support panel 14 in a substantially horizontal direction to terminate in an upturned free-end 22. Product support bracket 12 is of a standard type known in the industry and has a length "c" as measured from leg portion 28 to free-end 22.

Information display bracket 10 includes a display arm 34 which has a flattened, triangularly shaped proximal end 36 hingedly secured to a base member 40 that is mounted in a pair of mounting holes 16 which are in the same column as the mounting holes receiving prongs 26 but which are preferably located in the next upwardly adjacent row. Thus, as shown in FIG. 1, prongs 26 are received in two mounting holes 16 occupying matrix positions $r_2,c_2$ and $r_2,c_3$ while base 40 is mounted in mounting holes 16 that occupy matrix positions $r_3,c_2$ and $r_3,c_3$. Display arm 34 terminates in a flattened distal end 38 opposite proximal end 36; distal end 38 is preferably in the shape of a flattened rectangle.

An information display plate 42 is located on distal end 38 of display arm 34 and, as is shown in FIG. 2, the length of display arm 34, as measured from base member 40, is slightly longer than the length of a selected product support arm so that information display plate 42 extends forwardly of free-end 22 and such that flattened distal end 38 rests on free-end 22. Information display arm 34 is hingedly secured to base member 40 by means of a living hinge 44 of a type described in my U.S. Pat. No. 5,082,215. Living hinge 44 is preferably oriented horizontally so that display arm 34 and information display plate 42 may freely pivot in a direction of arrow "A" in FIGS. 1 and 2 which is in a vertical plane that is perpendicular to support panel 14.

Figure 3:
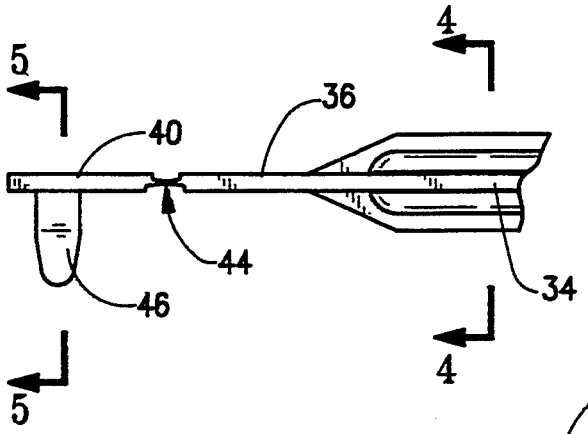
FIG. 3 is a side view in elevation of the information display bracket shown in FIGS. 1 and 2 as produced by injection molding.
Figure 3:
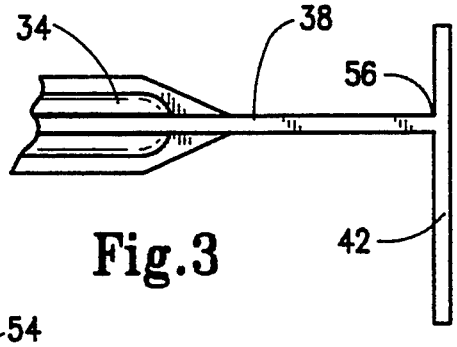
Figure 4:
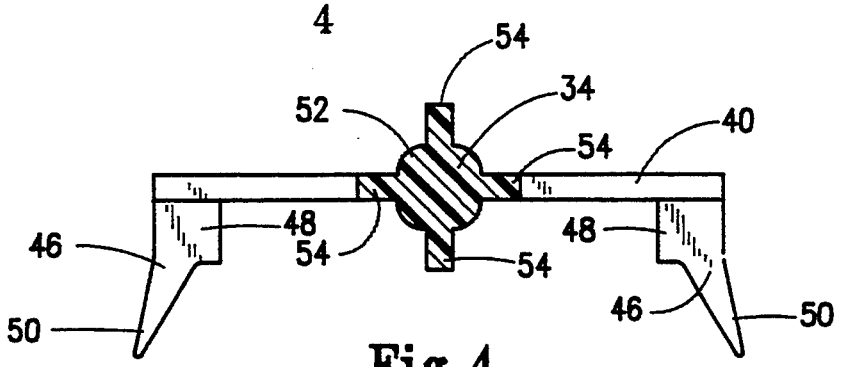
FIG. 4 is a cross-sectional view taken about lines 4—4 of FIG. 3.
Figure 5:
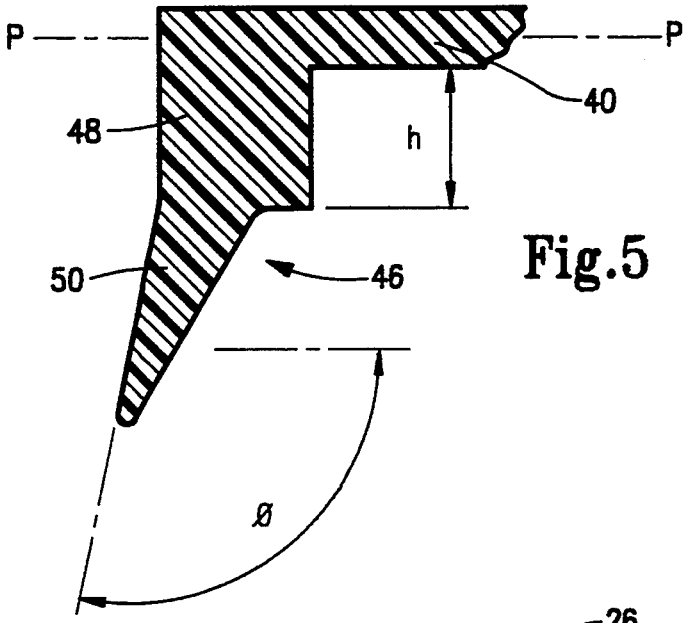
FIG. 5 is a cross-sectional view taken about lines 5—5 of FIG. 3.

As best shown in FIGS. 2–4, mounting base 40 has a pair of mounting posts 46 which project rearwardly therefrom when mounting base 40 is in a fastened state in pegboard support panel 14 as is shown in FIG. 2. Each mounting post 46 includes a cylindrical post base 48 and a wing portion 50 supported thereon. It may be seen in FIG. 4, that the respective wing portions 50 on a pair of mounting posts 46 are rearwardly divergent from one another so that they are separated a distance that is greater than the distance separating cylindrical posts 48 (which, in turn, corresponds to the distance between a pair of horizontally mounting holes 16). Accordingly, as may be seen in FIG. 5, each wing portion 50 is oriented at a small obtuse angle $\phi$ with respect to a mounting plane "P" which corresponds to the plane of base member 40. Preferably, this angle $\phi$ is approximately 100°.

With reference again to FIGS. 2–4, it may be seen that information display arm 34 is constructed as a cylindrical bar 52 which is strengthened by reinforcing ribs 54 that are equalangularly spaced around the circumference of cylindrical bar 52. Furthermore, flattened distal end 38 is formed to have a thickness approximately the same as flattened proximal end 36 with both ends 36 and 38 having a thickness equal to the thickness of reinforcing ribs 54. Distal end 38 has a forward edge 56 that is coextensive with information display plate 42 and extends for the width of plate 42. As may also be seen in these FIGS. 2–4, information display plate 42 and flattened distal end portion 38 are substantially perpendicular to one another in planes that are each perpendicular to the pivot plane defined by the pivoting of display arm 34 in the direction of arrow "A". Hence, the plane of information display plate 42 is substantially parallel to the plane of support panel 14.

Figure 6:
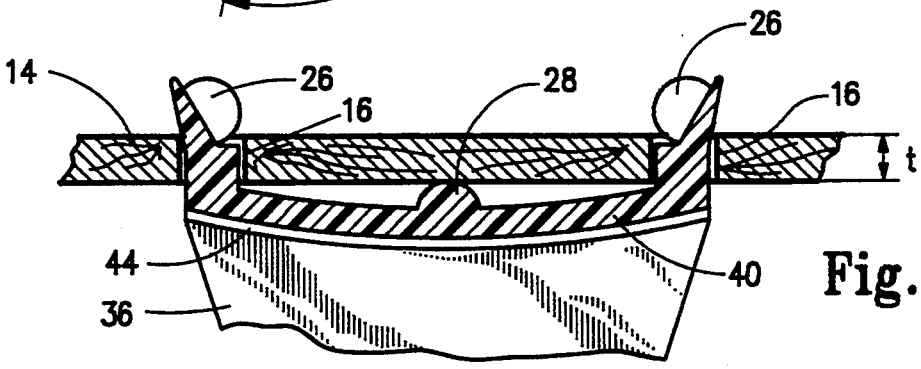
FIG. 6 is a top view of the mounting base structure taken in cross-section about lines 6—6 of FIG. 1.

Information display bracket 10 is preferably formed as an integral piece of molded plastic material which may, for example, be conveniently fabricated by injection molding techniques, as is known in the art. Suitable plastic materials include polypropylene, K resin or high impact polystyrene. The ordinarily skilled injection engineer will recognize, with reference to FIGS. 3 and 4, that no undercuts are present in this design thereby simplifying the complexity of the product mold. Furthermore, with reference to FIGS. 5 and 6, it may now be appreciated that the structure of mounting posts 46 are such that the pair of mounting posts 46 are configured to frictionally engage a pair of second mounting holes thereby to fasten a base member 40 in a fastened state against support panel 14. Furthermore, this configuration resists withdrawal from the second mounting holes. To this end, the cylindrical post base 48 of each mounting post 46 has a diameter that is slightly smaller than the diameter of each mounting hole 16. The height "h" of each post base 48 as measured from base member 40 is equivalent to the thickness "t" of support panel 14. When placed in the fastened state, as is shown in FIG. 6, the rearward divergence of wing portions 50 causes a slight bowing of base member 40 along a large radius in order to provide a resiliently locking feature in cooperation with the frictional engagement of mounting posts 46 due to the stiff resiliency of the plastic material out of which base member 40 is constructed. This, then, helps prevent inadvertent dislodgment of information display bracket 10 from support panel 14 while at the same time allowing fastening of base member 40 into a pair of mounting holes 16 without disturbing the respective product support brackets 12 or the products disposed thereon.

Figure 7:
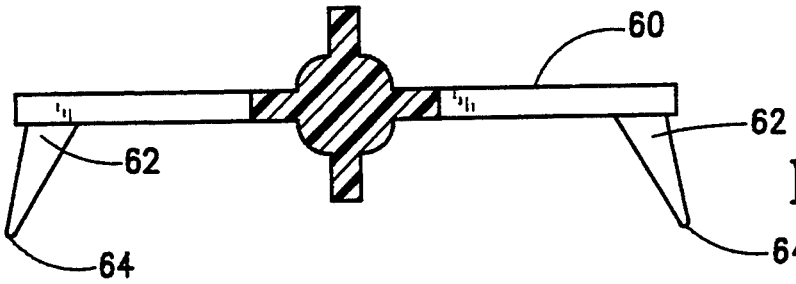
FIG. 7 is a cross-sectional view, similar to FIG. 4, showing a first alternative mounting base structure.

FIG. 7–11 show alternative embodiments of exemplary forms of the present invention and, specifically, show modifications to the base member thereof. Thus, for example, an alternative base member 60 is shown in FIG. 7 wherein a pair of mounting posts 62 are each in the form of wing portions which extend from mounting base 60 to terminate in rearward tips 64. This structure is similar to that shown in FIG. 4 with the exception that mounting posts 62 taper continuously from mounting base 60 to tip 64 so that they are outwardly divergent from one another. This structure eliminates the cylindrical post base 48 described with respect to FIG. 4.

Figure 8:
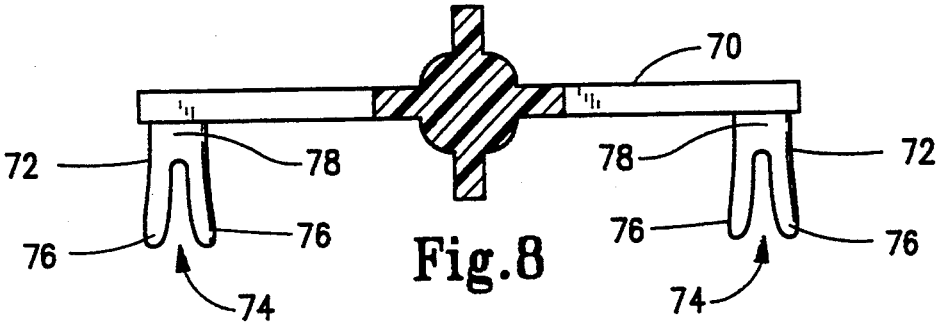
FIG. 8 is a cross-sectional view, similar to FIGS. 4 and 7, showing a second alternative mounting base structure.

In FIG. 8, mounting base 70 is provided with a pair of mounting posts 72 each of which includes a post base 78 which is again of a height that is equivalent to the thickness of a support panel 14. Each cylindrical post base 78 supports a pair of wing portions 76 which are slightly outwardly divergent from one another and are separated by a notch 74. When fastening mounting base 70 to a support panel 14, notch 74 allows wing portions 76 to compress towards one another to allow insertion through a mounting hole 16; wing portions 76 are thus resiliently biased outwardly from one another to help frictionally and resiliently retain base member 70 in the fastened state.

Figure 9:
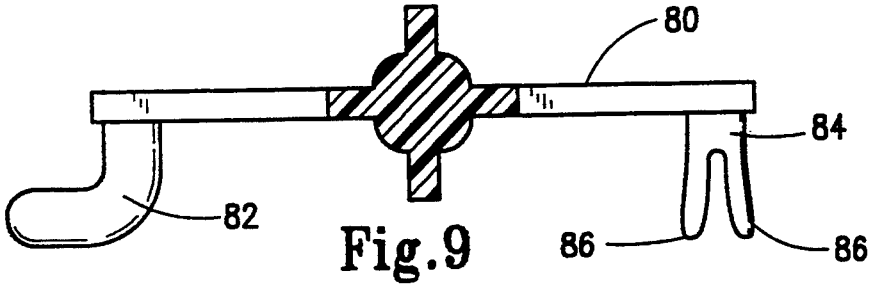
FIG. 9 is a cross-sectional view, similar to FIGS. 4, 7 and 8, showing a third alternative embodiment of a mounting base structure.
Figure 10:
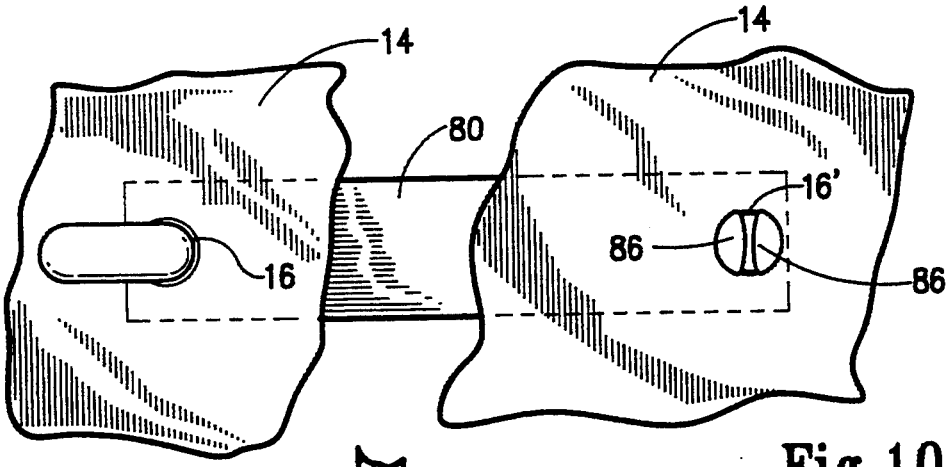
FIG. 10 is a rear end view, partially brokenaway, showing the mounting of the mounting base structure of FIG. 9 in an upright pegboard support.

In FIGS. 9 and 10, a fourth alternative base member structure 80 is shown. Here, a first, mounting post 82 is in the form of an arcuate finger which rearwardly projects from base member 80 so that, as shown in FIG. 10 it may be canted into a respective mounting hole 16. When in the fastened state, it should be appreciated that finger 82 is horizontally disposed. A second mounting post 84 is configured similarly to mounting post 72 described with respect to FIG. 8 so that, after canting finger 82 through a mounting hole 16, mounting post 84 has a pair of wing portions 86 which compress towards one another and resiliently engage a mounting hole 16'.

Figure 11:
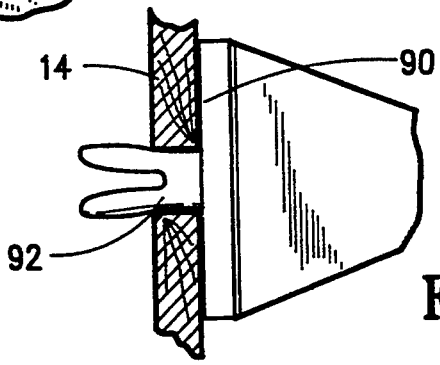
FIG. 11 is a top view, similar to FIG. 6, showing a fourth alternative embodiment of a mounting base structure.

Finally, with respect to FIG. 11, it may be seen that in certain instances it is desired that a base member, such as base member 90 be provided with a single mounting post 92 which is configured similarly to mounting post 72 and 84. This structure is useful when mounting to a support panel 14 in conjunction with a product support bracket that is mounted itself in one or more mounting holes 16 located in a single column in the matrix of mounting holes. Thus, utilizing a single mounting post allows positioning of the information display bracket directly above the single column mounted product bracket. Naturally, it would be possible to use a base member for the information display brackets described in this invention utilizing three or more mounting posts to engage three or more mounting holes in a row in the matrix, and any of these structures are deemed to be included within the disclosure of this invention.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

I claim:

1. An information display bracket adapted to be used in conjunction with a product support bracket having a product support arm for supporting product thereon and a mounting base for mounting on an upright support panel having a plurality of mounting holes extending therethrough and organized in a matrix having vertical columns and horizontal rows, said mounting base having at least one rearwardly projecting prong sized and positioned to extend through a first mounting hole located in a selected first row of said matrix so that said product support arm extends forwardly of said support panel to terminate in a free end when in a mounted state, aid information display bracket comprising:

(a) a base member including at least one mounting post projecting rearwardly therefrom and sized to extend through a second mounting hole located in a second selected row of said matrix above said mounting base, said mounting post configured to fractionally engage said second mounting hole thereby to fasten said base member in a fastened sate to said support panel and configured to resist withdrawal from said second mounting hole;

(b) a hinge structure disposed on said base member;

(c) a display arm having a proximal end interconnected to said base member by said hinge structure whereby said display arm freely pivots about a horizontal pivot axis in a single plane that is perpendicular to said support panel when said base member is in the fastened state, said display arm having a distal end including a flattened distal end portion opposite said proximal end, said display arm projecting forwardly of said support panel when said base member is in the fastened state; and (d) an information display plate located on the distal end of said display arm, said display arm being sized so that said display plate is oriented forwardly of the free end of said product arm when said product support bracket is in the mounted state and said base member is in the fastened state, said display arm operative to pivot in the pivot plane between a first position wherein said flattened distal end portion is supported on the free end of said product arm and a second position wherein said flattened distal end portion is supported on the free end of said product arm and a second position wherein said flattened distal end portion and said display plate are located away from the free end of said product arm so that said products may be removed from said product, said base member, said hinge structure, said display arm and said display plate being of an integral one-piece construction.

2. An information display bracket according to claim 1 wherein said mounting post includes a pair of wing portions which diverge from one another.

3. An information display bracket according to claim 2 wherein the mounting holes in said support panel are circular in shape and said support panel is of a selected first thickness, said wing portions being supported on a post base that is cylindrical in shape of common diameter with said mounting holes and of a height as measured from said base member that is approximately the same as the thickness of said support panel.

4. An information display bracket according to claim 1 wherein said hinge structure is a living hinge interconnecting said base member and said display arm, said living hinge structure operative to permit the vertical pivoting therebetween.

5. An information display bracket according to claim 1 wherein said flattened distal end portion is rectangular in shape.

6. An information display bracket according to claim 6 wherein said flattened distal end portion is oriented in a plane perpendicular to said pivot plane and is oriented perpendicularly to said display plate, said flattened distal end portion having a forward edge coextensive with said display plate.

7. An information display bracket adapted to be used in conjunction with a product support bracket having a product support arm for supporting product thereon and a mounting base for mounting on an upright support panel having a plurality of mounting holes extending therethrough and organized in a matrix having vertical columns and horizontal rows, said mounting base having at least one rearwardly projecting prong sized and positioned to extend through a first mounting hole located in a selected first row of said matrix so that said product support arm extends forwardly of said support panel to terminate in a free end when in a mounted state, said information display bracket comprising:

(a) a base member including a pair of spaced-apart mounting posts projecting rearwardly therefrom and sized to extend through a pair of second mounting holes located in a second selected row of said matrix above said mounting base, each of said mounting posts including a wing portion configured to engage said second mounting holes thereby to fasten said base member in a fastened state to said support panel and configured to resist withdrawal from said second mounting holes, said wing portions being rearwardly divergent from one another, with each said wing portion oriented at an obtuse angle with respect to said base member;

(b) a display arm having a proximal end hingedly secured to said base member and a distal end including a flattened distal end portion opposite said proximal end, said display arm projecting forwardly of said support panel when said base member is in the fastened state; and (c) an information display plate located on the distal end of said display arm, said display arm being sized so that said display plate is oriented forwardly of the free end of said product arm when said product support bracket is in the mounted state and said base member is in the fastened state, said display arm operative to pivot in a pivot plane perpendicularly to said support panel between a first position wherein said flattened distal end portion is supported on the free end of said product arm and a second position wherein said flattened distal end portion and said display plate are located away from the free end of said product arm so that said products may be removed from said product arm.

8. An information display bracket according to claim 7 wherein the mounting holes in said support panel are circular in shape and said support panel is of a selected first thickness, each wing portion being supported on a post base that is cylindrical in shape of common diameter with said mounting holes and of a height as measured from said base member that is approximately the same as the thickness of said support panel.

9. An information display bracket according to claim 12 wherein said mounting posts and said base member are formed of a stiff yet resilient plastic material whereby, when said base member is in the fastened state, said mounting posts are resiliently biased to engage said second mounting holes.

10. An information display bracket according to claim 9 wherein said base member is formed as a flat piece of said plastic material and wherein said mounting posts are positioned such that said base member is arcuately bowed when in the fastened state.

11. An information display bracket according to claim 7 wherein said base member, said display arm and said display bracket are formed as an integral piece of molded plastic material and including a living hinge structure interconnecting said base member and said display arm, said living hinge structure operative to permit the vertical pivoting therebetween.

12. An information display bracket according to claim 7 wherein said flattened distal end portion is rectangular in shape.

13. An information display bracket adapted to be used in conjunction with a product support bracket having a product support arm for supporting product thereon and a mounting base for mounting on an upright support panel having a plurality of mounting holes extending therethrough and organized in a matrix having vertical columns and horizontal rows, said mounting base having at least one rearwardly projecting prong sized and positioned to extend through a first mounting hole located in a selected first row of said matrix so that said product support arm extends forwardly of said support panel to terminate in a free end when in a mounted state, said information display bracket comprising:

(a) a base member including a plurality of mounting posts projecting rearwardly therefrom and sized to extend through second mounting holes located in a second selected row of said matrix above said mounting base, said mounting posts configured to engage said second mounting holes thereby to fasten said base member in a fastened state to said support panel and configured to resist withdrawal from said second mounting holes, a first one of said mounting posts being formed as an arcuate finger oriented horizontally when said mounting base is in the fastened state;

(b) a display arm having a proximal end hingedly secured to said base member and a distal end including a flattened distal end portion opposite said proximal end, said display arm projecting forwardly of said support panel when said base member is in the fastened state; and (c) an information display plate located on the distal end of said display arm, said display arm being sized so that said display plate is oriented forwardly of the free end of said product arm when said product support bracket is in the mounted state and said base member is in the fastened state, said display arm operative to pivot in a pivot plane perpendicularly to said support panel between a first position wherein said flattened distal end portion is supported on the free end of said product arm and a second position wherein said flattened distal end portion and said display plate are located away from the free end of said product arm so that said products may be removed from said product arm.

14. An information display bracket according to claim 13 wherein said second one of said mounting posts includes a pair of wing portions which diverge from one another.

15. An information display bracket adapted to be used in conjunction with a product support bracket having a product support arm for supporting product thereon and a mounting base for mounting on an upright support panel having a plurality of mounting holes extending therethrough and organized in a matrix having vertical columns and horizontal rows, the mounting holes in said horizontal rows being spaced-apart from one another a selected distance, said mounting base having at least one rearwardly projecting prong sized and positioned to extend through a first mounting hole located in a selected first row of said matrix so that said product support arm extends forwardly of said support panel to terminate in a free end when in a mounted state, said information display bracket comprising:

(a) a base member including a plurality of mounting posts projecting rearwardly therefrom and sized to extend through second mounting holes located in a second selected row of said matrix above said mounting base, said mounting posts spaced-apart from one another a distance greater then said selected distance and configured to engage said second mounting holes thereby to fasten said base member in a fastened state to said support panel and configured to resist withdrawal from said second mounting holes said base member and said mounting posts being formed of a stiff yet resilient plastic material whereby, when said base member is in the fastened state, said mounting posts are resiliently biased to engage said second mounting holes, said base member formed as a flat piece such that said base member is arcuately bowed when in the fastened state;

(b) a display arm having a proximal end hingedly secured to said base member and a distal end including a flattened distal end portion opposite said proximal end, said display arm projecting forwardly of said support panel when said base member is in the fastened state; and (c) an information display plate located on the distal end of said display arm, said display arm being sized so that said display plate is oriented forwardly of the free end of said product arm when said product support bracket is in the mounted state and said base member is in the fastened state, said display arm operative to pivot in a pivot plane perpendicularly to said support panel between a first position wherein said flattened distal end portion is supported on the free end of said product arm and a second position wherein said flattened distal end portion and said display plate are located away from the free end of said product arm so that said products may be removed from said product arm.

16. An information display bracket according to claim 15 wherein a first one of said mounting posts is formed as an arcuate finger operative to engage one of said second mounting holes and a second one of said mounting posts is operative to frictionally engage another of said second mounting holes.

17. An information display bracket according to claim 16 wherein said arcuate finger is disposed in a horizontal plane when said mounting base is in the fastened state.

18. An information display bracket according to claim 16 wherein said second one of said mounting posts includes a pair of wing portions which diverge from one another.

19. An information display bracket according to claim 15 wherein there are a pair of said mounting posts each including a wing portion, said wing portions being rearwardly divergent from one another.

20. An information display bracket adapted to be used in conjunction with a product support bracket having a product support arm for supporting product thereon and a mounting base for mounting on an upright support panel having a plurality of mounting holes extending therethrough and organized in a matrix having vertical columns and horizontal rows, said mounting base having at least one rearwardly projecting prong sized and positioned to extend through a first mounting hole located in a selected first row of said matrix so that said product support arm extends forwardly of said support panel to terminate in a free end when in a mounted state, said information display bracket comprising:

(a) a base member having an upper edge and a lower edge and including at least one mounting post projecting rearwardly therefrom and sized to extend through a second mounting hole located in a second selected row of said matrix above said mounting base, said mounting post configured to frictionally engage said second mounting hole thereby to fasten said base member in a fastened state to said support panel and configured to resist withdrawal from said second mounting hole;

(b) a display arm having a proximal end hingedly secured to said base member along said lower edge and a distal end opposite said proximal end, said display arm projecting forwardly of said support panel when said base member is in the fastened state; and (c) an information display plate located on the distal end of said display arm, said display arm being sized so that said display plate is oriented forwardly of the free end of said product arm when said product support bracket is in the mounted state and said base member is in the fastened state with a portion of said display plate depending downwardly in front of the free end of said product arm, said display arm operative to pivot along a horizontal axis in a pivot plane perpendicular to said support panel between a first position wherein said distal end is downwardly biased and supported on the free end of said product arm and a second position wherein said distal end and said display plate are located away from the free end of said product arm so that said products may be removed from said product arm, said base member, said display arm, and said information display plate being of an integral, one-piece construction.

* * * * *